US008978608B2

(12) United States Patent
Tadokoro et al.

(10) Patent No.: US 8,978,608 B2
(45) Date of Patent: Mar. 17, 2015

(54) VALVE TIMING CONTROL APPARATUS FOR INTERNAL COMBUSTION ENGINE

(71) Applicant: Hitachi Automotive Systems, Ltd., Hitachinaka-shi, Ibaraki (JP)

(72) Inventors: Ryo Tadokoro, Atsugi (JP); Hiroyuki Nemoto, Hitachi (JP); Atsushi Yamanaka, Atsugi (JP)

(73) Assignee: Hitachi Automotive Systems, Ltd., Hitachinaka-shi (JP)

( * ) Notice: Subject to any disclaimer, the term of this patent is extended or adjusted under 35 U.S.C. 154(b) by 0 days.

(21) Appl. No.: 14/065,753

(22) Filed: Oct. 29, 2013

(65) Prior Publication Data

US 2014/0123922 A1 May 8, 2014

(30) Foreign Application Priority Data

Nov. 7, 2012 (JP) ..... 2012-245000

(51) Int. Cl.
*F01L 1/34* (2006.01)
*F01L 1/344* (2006.01)

(52) U.S. Cl.
CPC ..... *F01L 1/344* (2013.01); *F01L 2820/032* (2013.01)
USPC ..... 123/90.17; 123/90.15; 464/160

(58) Field of Classification Search
USPC ..... 123/90.15, 90.17; 464/160
See application file for complete search history.

(56) References Cited

U.S. PATENT DOCUMENTS 7,624,710 B2 * 12/2009 Uehama et al. ..... 123/90.17

FOREIGN PATENT DOCUMENTS

JP 2011-256798 A 12/2011

* cited by examiner

*Primary Examiner* — Ching Chang
(74) *Attorney, Agent, or Firm* — Foley & Lardner LLP

(57) ABSTRACT

In a valve timing control apparatus for an internal combustion engine, a plurality of projection sections projected toward a cover member are integrally mounted on a bearing member configured to rotatably journalize a camshaft and a plurality of positioning pins are mounted across (or extended over) the cover member and the respective projection sections.

15 Claims, 5 Drawing Sheets

VALVE TIMING CONTROL APPARATUS FOR INTERNAL COMBUSTION ENGINE

BACKGROUND OF THE INVENTION (1) Field of the Invention

The present invention relates to a valve timing control apparatus for an internal combustion engine which controls valve open-and-closure characteristics of an intake valve(s) or an exhaust valve(s) of the internal combustion engine.

(2) Description of Related Art

Recently, a valve timing control apparatus has been proposed in which a phase modification mechanism which converts a relative rotational phase of a camshaft with respect to a sprocket to which a rotational force from a crankshaft is transmitted by transmitting a rotational force of an electrically driven motor to a camshaft which provides an output axle via a speed reduction mechanism to control open-and-closure timings of an intake valve(s) and/or an exhaust valve (s).

Such a valve timing control apparatus as described above is exemplified by a Japanese Patent Application First Publication No. 2011-256798 published on Dec. 22, 2011 in which a power supply to the electrically driven motor is carried out by means of an electrical contact between a brush mounted on a cover member arranged at a forward side of the phase modification mechanism and a slip ring installed at the phase modification mechanism side.

SUMMARY OF THE INVENTION

However, in the valve timing control apparatus described in the above-described Japanese Patent Application First Publication, the cover member on which the brush is mounted is fixed on a chain cover and the phase adjustment mechanism on which the slip ring is installed is rotatably supported on a bearing member installed on a cylinder head via the camshaft.

Therefore, at a time of an assembly of each component, a relative position of a center of a working hole disposed on the cover member and an axial center of an output axle of the electrically driven motor are matched with each other using a jig or so forth so that no positional deviations between the brush and the slip ring and between a seal member disposed on an inner periphery of the cover member and an outer periphery of the phase modification mechanism occur. Then, upon the end of the above-described matching adjustment of the relative position, it is necessary to fix the cover member to the chain cover. Therefore, a positioning work related thereto becomes complicated.

It is, hence, an object of the present invention to provide a valve timing control apparatus for an internal combustion engine which can facilitate the assembly work of each component described above while suppressing the positional deviation between the cover member and the phase modification mechanism.

According to one aspect of the present invention, there is provided a valve timing control apparatus for an internal combustion engine, comprising: a driving rotary body to which a rotational force is transmitted from a crankshaft; a driven rotary body fixed to a camshaft; an electrically driven motor fixed to the driving rotary body; a speed reduction mechanism configured to reduce a rotation of the electrically driven motor and to transmit the reduced rotation to the driven rotary body; a phase modification mechanism which is capable of modifying a relative rotational phase of the camshaft with respect to the driving rotary body in accordance with an engine state; a cover member arranged at the tip side of the phase modification mechanism and fixed to a chain cover of the internal combustion engine; a pair of inner and outer periphery slip rings disposed on either one of a tip surface of the phase modification mechanism or another tip surface of the cover member opposed to the tip surface of the phase modification mechanism to supply an electric power to the electrically driven motor; and a pair of brushes disposed on either the other of the tip surface of the phase modification mechanism or the other tip surface of the cover member and constructed to slidably contact on the respective slip rings, wherein a plurality of projection sections projected toward the cover member are integrally mounted on a bearing member configured to rotatably journalize the camshaft and a plurality of positioning pins are extended over the cover member and the respective projection sections.

According to another aspect of the present invention, there is provided a valve timing control apparatus for an internal combustion engine, comprising: a driving rotary body to which a rotational force is transmitted from a crankshaft; a driven rotary body fixed to a camshaft; an electrically driven motor fixed to the driving rotary body; a speed reduction mechanism configured to reduce a rotation speed of the electrically driven motor and to transmit the speed reduced rotation to the driven rotary body; a phase modification mechanism which is capable of modifying a relative rotational phase of the camshaft with respect to the driving rotary body in accordance with an engine state; a cover member arranged at a tip side of the phase modification mechanism and fixed to a side surface of the internal combustion engine; a pair of inner and outer periphery slip rings disposed on either one of a tip surface of the phase modification mechanism or another tip surface of the cover member opposed to the tip surface of the phase modification mechanism to supply an electric power to the electrically driven motor; and a pair of brushes disposed on either the other of the tip surface of to the phase modification mechanism or the other tip surface of the cover member and constructed to slidably contact on the respective slip rings, wherein the cover member is fixed to the side surface of the internal combustion engine in a state in which the cover member is positioned from a radial direction of the camshaft with respect to a rotation center of the camshaft by means of a positioning section disposed on a bearing member rotatably journaling the camshaft.

According to a still another aspect of the present invention, there is provided a valve timing control apparatus for an internal combustion engine, comprising: a driving rotary body to which a rotational force is transmitted from a crankshaft; a driven rotary body fixed to a camshaft; an electrically driven motor fixed to the driving rotary body; a speed reduction mechanism configured to reduce a rotation of the electrically driven motor and to transmit the reduced rotation to the driven rotary body; a phase modification mechanism which is capable of modifying a relative rotational phase of the camshaft with respect to the driving rotary body in accordance with an engine state; a cover member arranged at a tip side of the phase modification mechanism to cover at least part of the phase modification mechanism and fixed to a chain cover of the internal combustion engine; and a seal member fixed to either one of an inner periphery of the cover member and an outer periphery of the phase modification mechanism to slide on either the other of the inner periphery of the cover member and the outer periphery of the phase modification mechanism, wherein a plurality of projection sections projected toward the cover member are integrally mounted on a bearing member rotatably journaling the camshaft and positioning pins are interposed between the cover member and the respective projection sections.

DETAILED DESCRIPTION OF THE INVENTION

Hereinafter, a preferred embodiment of a valve timing control apparatus for an internal combustion engine according to the present invention will be described on a basis of the attached drawings. It should be noted that this embodiment is applicable to a variably operated valve system at an intake side of the internal combustion engine. However, the present invention is similarly applicable to the variably operated valve system at an exhaust side of the internal combustion engine.

Figure 1:
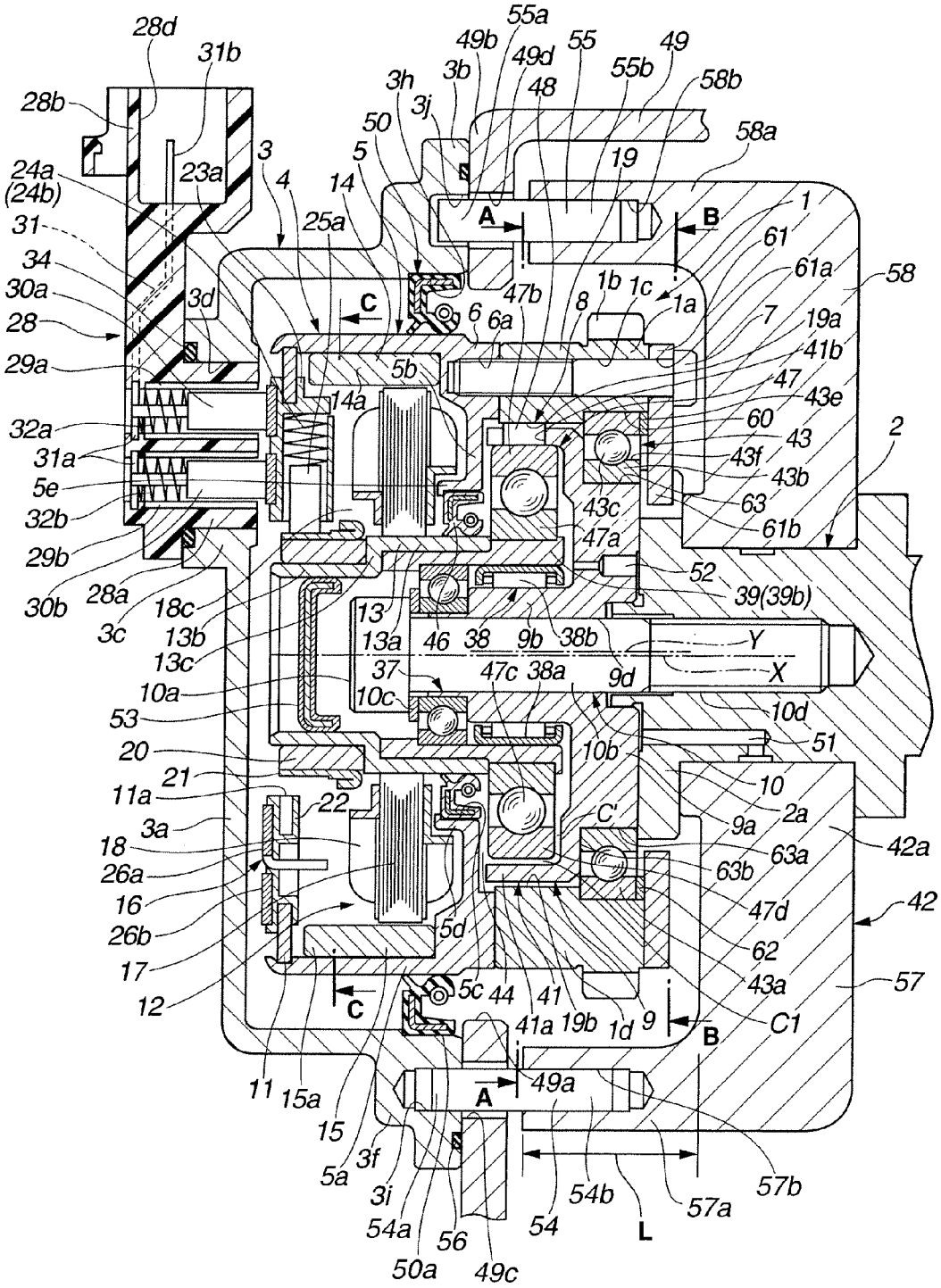
FIG. 1 is a longitudinal cross sectional view representing a preferred embodiment of a valve timing control apparatus according to the present invention.
Figure 2:
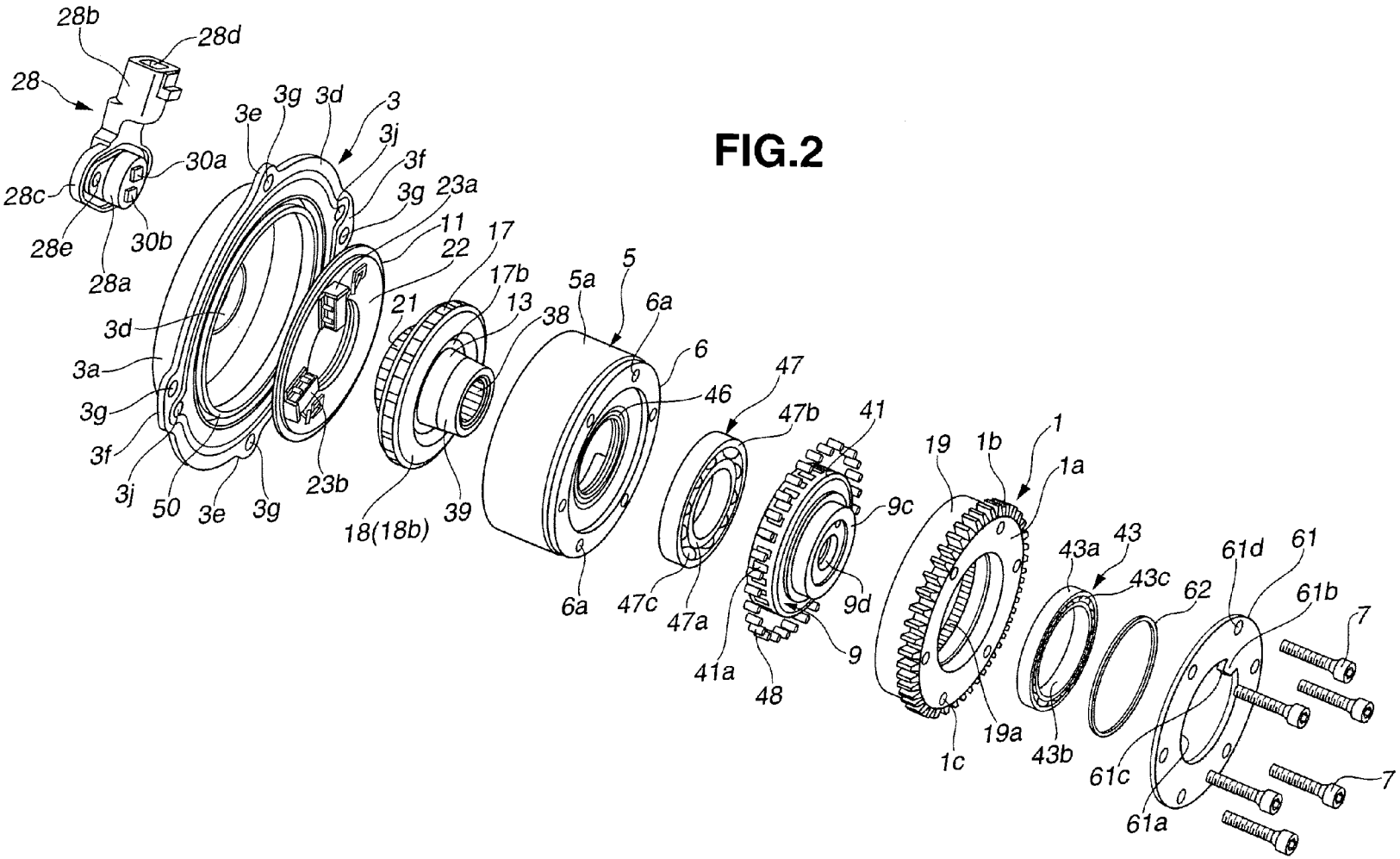
FIG. 2 is an exploded perspective view of main components in the preferred embodiment shown in FIG. 1.

This valve timing control apparatus, as shown in FIGS. 1 and 2, includes: a timing sprocket 1 which is a driving rotary body rotatably driven by means of a crankshaft of the internal combustion engine; a camshaft 2 rotatably journalled by means of a bearing member 42 to installed on a cylinder head to rotate a rotational force transmitted from timing sprocket 1; a cover member 3 fixed by means of a chain cover 49 disposed on an outside of timing sprocket 1; and a phase modification mechanism 4 interposed between timing sprocket 1 and camshaft 2 to is modify a relative rotational phase between timing sprocket 1 and camshaft 2 in accordance with the engine driving state.

A whole of timing sprocket 1 is made of an iron series metal and integrally formed in a circular shape. Timing sprocket 1 includes: a sprocket main body 1*a* having an inner peripheral surface of a step difference diameter shape; a gear section 1*b* which receives the rotational force from the crankshaft via a wound timing chain (not shown), gear section 1*b* integrally mounted on the outer periphery of sprocket main body 1*a*; and an inner teeth constituent section 19 which is an inner teeth mesh section integrally mounted on the forward end side of sprocket main body 1*a*.

In addition, this timing sprocket 1 includes a single large diameter ball bearing 43 which is a bearing and which is intervened between sprocket main body 1*a* and a driven member 9 which is a driven rotary body as will be described later disposed on the forward end side of camshaft 2. Timing sprocket 1 and camshaft 2 are relatively rotatably supported on this large diameter ball bearing 43.

This large diameter ball bearing 43 includes: an outer wheel 43*a*; an inner wheel 43*b*; and balls 43*c* intervened between the outer and inner wheels 43*a*, 43*b*. This large diameter ball bearing 43 has outer wheel 43*a* fixed onto an inner peripheral side of sprocket main body 1*a* while inner wheel 43*b* is fixed onto the outer peripheral side of sprocket main body 1*a*.

This sprocket main body 1*a* has the inner peripheral side on which an annular shaped outer wheel fixture groove 60 opened to camshaft 2 side.

This outer wheel fixture groove 60 is formed in is a step difference diameter shape, has the inner peripheral surface into which outer wheel 43*a* of large diameter ball bearing 43 inserted from the axial direction, and makes a positioning in the one direction side in the axial direction of outer wheel 43*a*.

Inner teeth constituent section 19 is integrally installed on a forward end outer peripheral side of sprocket main body 1*a* and is formed in a cylindrical shape extended in a direction of electrically driven motor 12 of phase modification mechanism 4. A plurality of waveform shaped inner teeth 19*a* are formed on an inner periphery of inner teeth constituent section 19.

Figure 3:
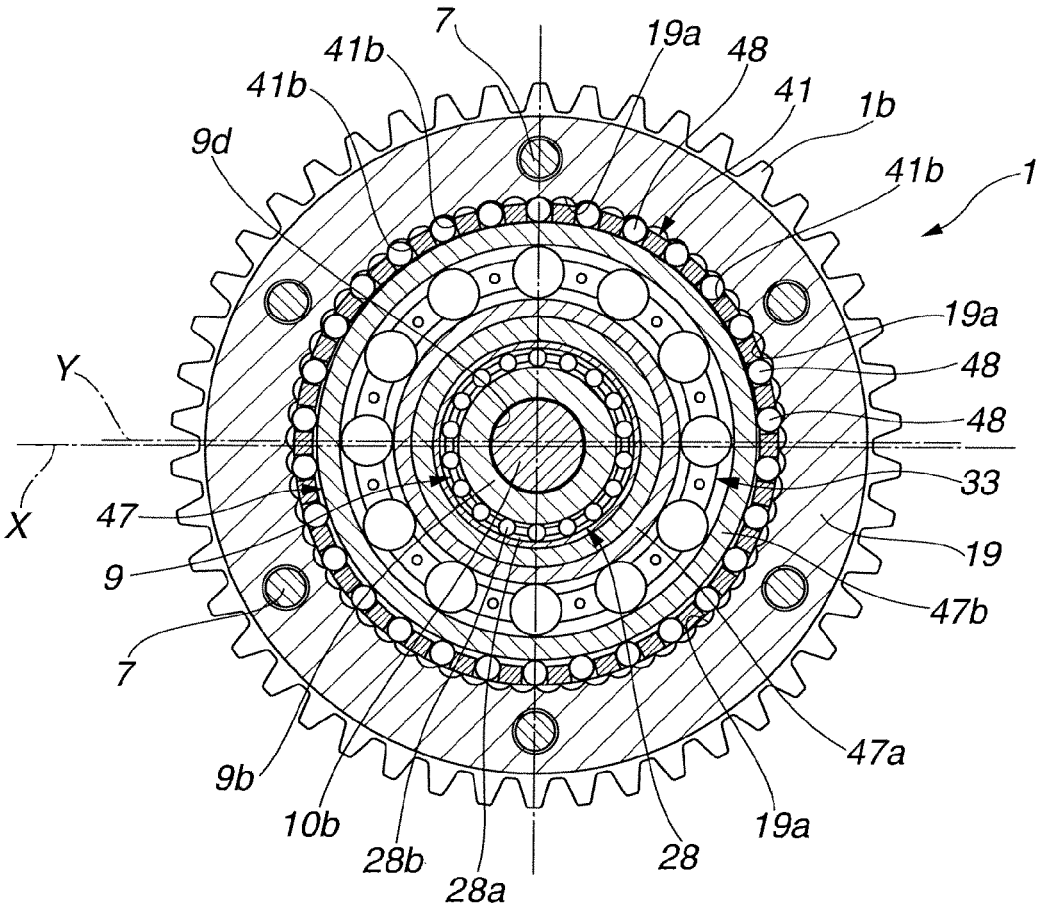
FIG. 3 is a cross sectional view cut away along a line of A to A in FIG. 1.

Respective inner teeth 19*a*, as shown in FIGS. 1 and 3, are continuously and plurally formed at equal intervals in a circumference direction and are constituted by mountain shaped addendum parts, both teeth surfaces continued from the addendum parts to both sides of respective inner teeth 19*a*; and bottomlands of teeth between both teeth surfaces.

In addition, a laser hardness process is carried out on the addendum parts and both teeth surfaces of respective inner teeth 19*a* in inner teeth constituent section 19 in the same way as gear section 1*b*, a hardness of these parts being formed to be higher than parts of the respective teeth bottomlands.

In addition, an annular female screw forming section 6 integral with a housing 5 of electrically driven motor 12 is opposed against the forward end side of inner teeth constituent section 19, as will be described later.

An annular holding plate 61 is disposed on a rear end section of sprocket 1 opposite to inner teeth constituent section 19 of sprocket main body 1*a*. This holding plate 61 is integrally formed by a metallic plate material. As shown in FIG. 1, an outer diameter of holding plate 61 is set to be generally the same as the outer diameter of sprocket main body 1*a*. In addition, an inner diameter of holding plate 61 is set to be a diameter in the vicinity to a generally center section of a diameter direction of large diameter ball bearing 43.

Hence, an inner peripheral section 61*a* of holding plate 61 is opposed with a constant gap to cover an outer end surface 43*e* in an axial direction of outer wheel 43*a* of large diameter ball bearing 43. In addition, a stopper convex section 61*b* is integrally disposed on an inner peripheral edge predetermined position of inner peripheral portion 61*a* and projected toward a center axis direction, namely, toward an inner side of the radial direction of outer wheel 43*a*.

Figure 4:
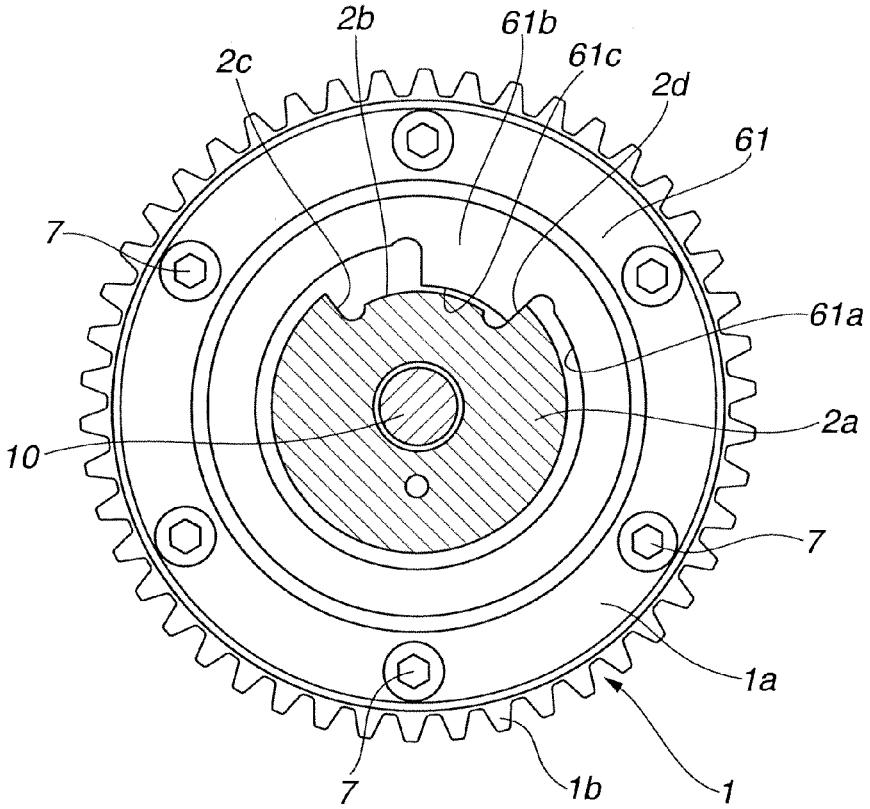
FIG. 4 is a cross sectional view cut away along a line of B to B in FIG. 1.

This stopper convex section 61*b* is, as shown in FIG. 4, formed in an approximately arc shape. Stopper convex section 61*b* has a tip edge 61*c* formed in an arc shape along an inner peripheral surface in the arc shape of a stopper groove 2*b* as will be described later. Furthermore, six bolt inserting holes 61*d* through which respective bolts 7 are inserted are penetrated through an outer peripheral surface in the arc shape of stopper groove 2*b* as will be described later at equal interval positions in the circumferential direction of holding plate 61.

Furthermore, an annular spacer 62 is interposed between an inner surface of holding plate 61 and outer end surface 43*e* of outer wheel 43*a* of large diameter ball bearing 43 opposed against the inner surface of holding plate 61 is tightened and fixed with this spacer 62 by means of respective bolts 7. At this time, spacer 62 provides a slight pressing force against an outer end surface 43*e* of outer wheel 43*a*. A wall thickness of this spacer 62 is set to a thickness to a degree such that a minute gap is formed within an axial directional movement allowable range in the axial direction of outer wheel 43*a* between outer end surface 43*e* of outer wheel 43*a* and holding plate 61.

Respective outer peripheral sections of sprocket main body 1*a* (inner teeth constituent section 19) and holding plate 61 have six bolt inserting holes 1*c*, 61*d* penetrated at substantially equal interval positions in the circumferential directions of sprocket main body 1*a* and holding plate 61. In addition, female screw forming section 6 is formed with six female screw holes 6*a* at positions corresponding to respective bolt inserting holes 1*c*, 61*d*. Six bolts 7 inserted into these holes allow the tightening fixture for timing sprocket 1, holding plate 61, and housing 5 from the axial direction of housing 5.

It should be noted that sprocket main body 1*a* and inner teeth constituent section 19 are constituted by a casing of speed reduction mechanism 8 as will be described later.

It should be noted that respective outer diameters of sprocket main body 1*a*, inner teeth constituent section 19, holding plate 61, and female screw forming section 6 are set to be approximately the same.

Chain cover 49 is disposed and fixed along a vertical direction of timing sprocket 1 to cover a chain wound on timing sprocket 1 at a forward end side of a cylinder head and a cylinder block (not shown) as shown in FIG. 1 and an opening section 49*a* is formed on a position corresponding to phase modification mechanism 4. Inserting holes 49*c*, 49*d* into which a pair of positioning pins 54, 55 as will be described later are loosely (movably) inserted are penetrated at both sides of an annular wall 49*b* constituting this opening section 49*a*.

Figure 6:
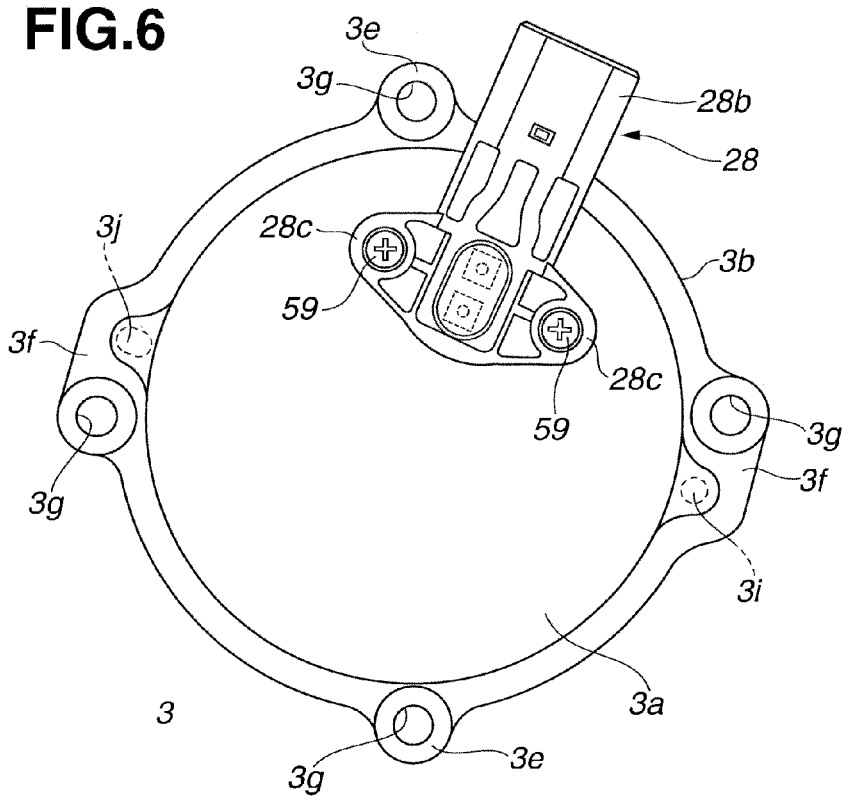
FIG. 6 is an outer side view of a cover member used in the preferred embodiment shown in FIG. 1.
Figure 7:
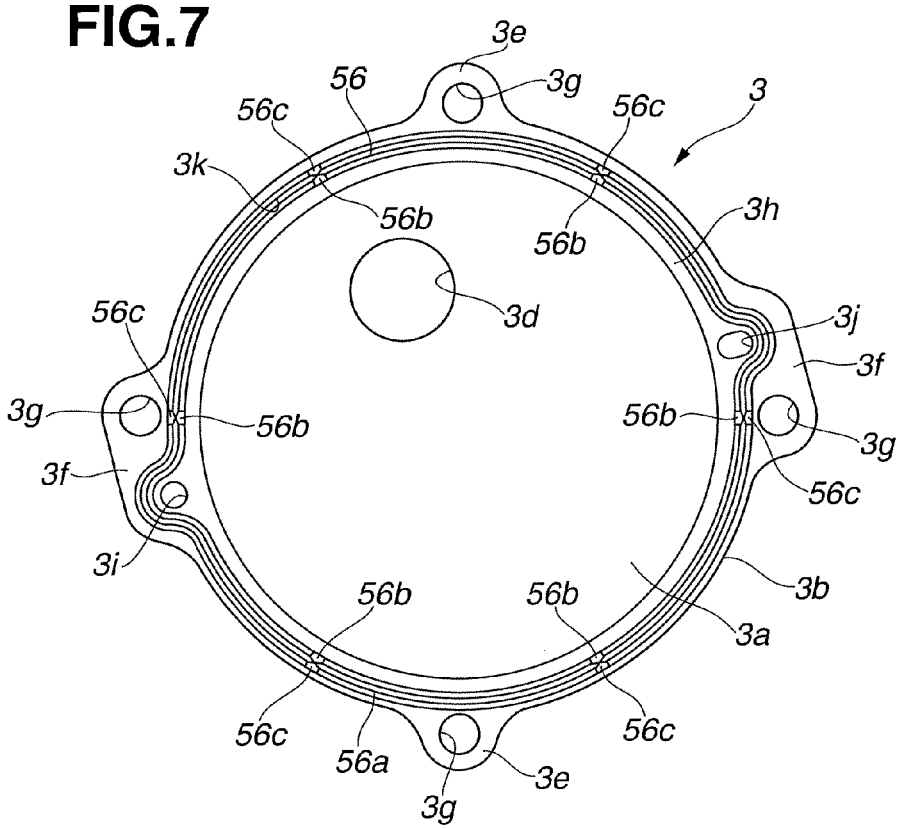
FIG. 7 is an inner side view of the cover member used in the preferred embodiment shown in FIG. 1.

Cover member 3, as shown in FIGS. 1, 6, and 7, is integrally formed in a cup shape of an aluminum alloy material and is constituted by a swelling cover main body 3*a* and an annular attachment flange 3*b* integrally formed on an outer peripheral edge of an opening side of cover main body 3*a*. Cover main body 3*a* is disposed so as to cover the forward end of housing 5 and a cylindrical wall 3*c* is integrally formed at the outer peripheral side of cover main body 3*a* along the axial direction of cover member 3. This cylindrical wall 3*c* has an inner part on which a holding hole 3*d* is formed and the inner peripheral surface of this holding hole 3*d* constitutes a guide surface of a brush holding body 28 as will be described later.

Four boss sections 3*e*, 3*f* are disposed at approximately equal interval positions (about 90° interval positions) in the circumferential direction of cover member 30. A bolt inserting hole 3*g* through which a bolt is inserted, the bolt screwed into a female screw hole not shown but is fitted into an annular wall 49*b* of chain cover 49. Thus, cover member 3 is fixed to chain cover 49 by means of respective bolts.

Furthermore, in FIG. 6, two boss sections 3*f*, 3*f* at both of left and right sides of cover member main body 3*a* are formed to be elongated in the circumferential direction of attaching flange 3*b*. In addition to respective bolt inserting holes 3*g* formed at one end section in the circumferential direction of attaching flange 3*b*, two positioning pin holes 3*i*, 3*j* through which one end sections 54*a*, 55*a* of the pair of positioning pins 54, 55 as will be described later are inserted are formed at forward end attaching surface side of attaching flange 3*b*. This one positioning pin hole 3*i* is formed in a circular shape but the other positioning pin hole 3*j* is formed in an elongate hole (eclipse) shape which is long in the diameter direction of attaching flange 3*b*.

A substantially annular seal holding groove 3*k* is formed along a circumferential direction as shown in FIG. 7 on an attaching surface 3*h* of attaching flange 3*b*. This seal holding groove 3*k* is wholly formed in a uniform width and is formed in a substantially annular shape. However, this seal holding groove 3*k* is formed in a curved shape toward outsides of respective positioning holes 3*i*, 3*j* and a seal ring 56 is fitted and held at an inner part of seal holding groove 3*k*.

This seal ring 56 is integrally formed of a synthetic resin rubber. This seal ring 56 has a cross section formed in a substantially circular shape. An outer diameter of seal main body 56*a* is formed to be sufficiently smaller than a groove width of seal holding groove 3*k*. Six stopper projection sections 56*b*, 56*c* are integrally mounted at approximately equal interval positions in the circumferential direction of seal main body 56*a*. These stopper projection sections 56*b*, 56*c* are two stopper projection sections projected toward both sides in the radial direction of seal main body 56*a*, namely, projected toward an inner peripheral side and toward an outer peripheral side with seal main body 56*a* as a center. The width in the radial direction of two stopper projection sections 56*b*, 56*c* is formed to be set to be larger than the groove width of seal holding groove 3*k*. Two stopper projection sections are elastically contacted on opposing surfaces of seal holding groove 3*k*. Utilizing this elastically contacting force, the whole seal ring 56 is held within seal holding groove 3*k*.

Then, seal ring 56 serves to seal between cover member 3 and chain cover 40 when cover member 3 is made contact on a forward surface of annular wall 49*b* of chain cover 49 and elastically contacted on annular wall 49*b*.

A large diameter oil seal 50 which is a seal member is interposed between an inner peripheral surface of a step difference section of an outer peripheral side of cover main body 3*a* and an outer peripheral surface of housing 5, as shown in FIG. 1. This large diameter oil seal 50 has a cross section formed in a substantially letter of a left inverted U shape. A cored bar is buried into an inside of a base material of the synthetic rubber. In addition, an annular base section 50*a* at the outer peripheral side is fitted and fixed to a step difference annular section installed on an inner peripheral surface of cover member 3.

Housing 5 includes: a housing main body 5*a* which is a cylindrical section formed of an iron-series metallic material in a bottomed cylindrical shape by means of a press forming; and a sealing plate 11 made of a non-magnetic material of a synthetic resin sealing a forward end opening of housing main body 5*a*.

A disk shaped bottom section 5*b* is provided at the rear end side of housing main body 5*a* and a large diameter axle section inserting hole 5*c* into which an eccentric axle section 39 is inserted as will be described later is formed at a substantially center of bottom section 5*b*. On a hole edge of axle section inserting hole 5*c*, a cylindrical extended section 5*d* projected in the axial direction of camshaft 2 is integrally formed. In addition, female screw forming section 6 is integrally formed at an outer peripheral side of a forward end surface of bottom section 5*b*.

Camshaft 2 is provided with two drive cams per cylinder at the outer periphery of camshaft 2 which actuates intake valve (s) to open not shown. Flange section 2*a* is integrally disposed on the forward end section of camshaft 2.

This flange section 2*a* has an outer diameter to be set to be slightly larger than an outer diameter of a fixture end section 9*a* of driven member 9 as will be described later, as shown in FIG. 1. After the assembly of each constituent member (component), the outer peripheral section of forward end surface 2*e* is contacted on the outer end surface in the axial direction of inner wheel 43*b* of large diameter ball bearing 43. In addition, forward end surface 2*e* is coupled with driven member 9 from the axial direction by means of a cam bolt 10 in a state in which forward end surface 2*e* is axially contacted on driven member 5.

A stopper recess groove 2*b* into which stopper convex section 61*b* of holing plate 61 is engageably inserted is formed along a circumferential direction of flange section 2*a*, as shown in FIG. 4. This stopper recess groove 2*b* is formed in the arc shape of a predetermined length in the circumferential direction of flange section 2*a*. Then, both end edges of stopper convex section 61*b* pivoted in this length range are respectively contacted against opposing edges 2*c*, 2*d* in the circumferential direction of camshaft 2. Thus, a relative rotational position of camshaft 2 with respect to timing sprocket 1 at a maximum advance angle side or at a maximum retardation angle side is limited.

It should be noted that stopper convex section 61*b* is spaced apart toward camshaft side 2 than a position of holding plate 61 opposed and fixed to outer wheel 43*a* of large diameter ball bearing 43 of holding plate from the outside of axial direction of outer wheel 43*a* so as to be in a non-contact state against fixture end section 9*a* of driven member 9. Hence, an interference between stopper convex section 61*b* and fixture end section 9*a* can sufficiently be suppressed.

A stopper mechanism is constituted by stopper convex section 61*b* and stopper recess groove 2*b*.

As shown in FIG. 1, bearing member 42 includes: a bearing main body (not shown) arranged plurally at a substantially equal interval position in the forward-or-rearward direction in a rectangular frame shape integrally formed along an outer periphery of an upper deck of the cylinder head; a bearing section 42*a* having a bearing groove 42*b* of a semi-circular shape at an upper surface of bearing section 42*a* by means of bolts (not shown); and a bearing bracket (not shown) fixed by means of bolts (not shown) on an upper end surface of bearing section 42*a*. A semi-circular bearing groove rotatably supporting camshaft 2 in cooperation with bearing groove 42*b* is formed on a lower surface of the bearing bracket.

In addition, projection sections 57, 58 are integrally installed on bearing member 42 at the forward end side of the engine shown in FIG. 1 which are a pair of arm shaped positioning sections projected in the radial direction (lateral direction) of camshaft 2 from both sides of bearing section 42*a*. These projection sections 57, 58 have tip sections 57*a*, 58*a* bent in a substantially letter L is shape projected in the forward direction of cover member 3 side. These tip sections 57*a*, 58*a* are formed in an elongated column shape and a projected length L is extended in a substantial center section in the axial direction of phase modification mechanism 4 from timing sprocket 1 side.

Pressing in pin holes 57*b*, 58*b* of projection sections 57, 58 into which other end sections 54*b*, 55*b* of respective positioning pins 54, 55 are pressed are formed by a predetermined length in the axial direction of projection sections 57, 58. Hence, both of positioning pins 54, 55 are disposed at about 180° in the circumferential direction of projection sections 57, 58.

An annular washer section 10*c* is arranged on an end surface of a head section 10*a* at an axle section 10*b* side as shown in FIG. 1 and a male screw section 10*d* screwed to a female screw section formed in an inner axle direction of camshaft 2 from the end section of camshaft 2 is formed on the outer periphery of axle section 10*b*.

Driven member 9 is integrally formed of the iron-series metal and, as shown in FIG. 1, includes: a disk shaped fixture terminal section 9*a* formed at the forward end side; a cylindrical section 9*b* projected in the axial direction from the inner peripheral forward end surface of fixture end section 9*a*; and a cylindrical retainer 41 integrally formed on the outer peripheral section of fixture end section 9*a* to retain a plurality of rollers 48.

Fixture end section 9*a* has a rear end surface contacted and arranged on the forward end surface of flange section 2*a* of camshaft 2 so as to be pressed and contacted from the axial direction by means of an axial force of cam bolt 10.

Cylindrical section 9*b* has a center section, as shown in FIG. 2, having an inserting hole 9*d* through which axle section 10*b* of cam bolt 10 is inserted and a needle bearing 38 is disposed on the outer peripheral side of cylindrical section 9*b*.

Retainer 41 is bent in a substantially letter L shape in cross section from the forward end of the outer periphery of fixture terminal section 9*a*, as shown in FIGS. 1 through 3, and formed in a bottomed cylindrical shape projected in the same direction as cylindrical section 9*b*. A cylindrical tip section 41*a* of this retainer 41 is extended in the direction of bottom section 5*b* of housing 5 via a spatial section 44 which is an annular recess section formed between female screw forming section 6 and extended section 5*d*. In addition, a plurality of elongated roller holding holes 41*b* in a substantially elongated shape which are a roller holding section which rollably holds the plurality of rollers 48 at substantially equal interval positions in the circumferential direction of tip end sections 41*a*. This roller holding holes 41*b* (roller 48) have whole numbers smaller than the whole teeth numbers of inner wheel 19*a* of inner teeth constituent section 19 by one.

Then, an inner wheel fixture section 63 which fixes inner wheel 43*b* of large diameter ball bearing 43 is cut out between the outer peripheral section of fixture end section 9*a* and the coupling section at the bottom side of retainer 41.

This inner wheel fixture section 63 is cut out in a step difference shape and is opposed against inner wheel fixture section 63 from a radial direction and includes: an annular outer peripheral surface 63*a* extended in a camshaft axial direction; and a second fixture step difference surface 63*b* integrally formed to be opposite to the opening of outer peripheral surface 63*a* and formed along a radial direction of inner wheel fixture section 63.

Inner wheel 43*b* of large diameter ball bearing 43 is pressed into outer peripheral surface 63*a* from the axial direction of large diameter ball bearing 43 and an inner end surface 43*f* of pressed in inner wheel 43*b* is contacted on second fixture step difference surface 63*b* to make the axial directional positioning.

Phase modification mechanism 4 includes: an electrically driven motor 12 arranged on the substantially coaxial forward end side of camshaft 2; and a speed reduction mechanism 8 which reduces a rotation speed of electrically driven motor 12 and transmits the reduced revolution speed to camshaft 2.

Electrically driven motor 12 is a DC motor with brush, as shown in FIGS. 1 and 2. Electrically driven motor 12 includes: housing 5 which is a yoke integrally rotated with timing sprocket 1; a motor output axle 13 rotatably mounted in an inside of housing 5; a pair of permanent magnets 14, 15 in a semi-arc shape which are stators fixed on the inner peripheral surface fixed on the inner peripheral surface of housing 5; and a stator 16 fixed onto sealing plate 11.

Motor output axle 13 functions as an armature formed in the step difference cylindrical shape and is constituted by a large diameter section 13*a* at camshaft 2 side via a step difference section 13*c* formed at the substantial center position of motor output axle 13 in the axial direction of output axle 13 and a small diameter section 13*b* located at a brush holding body 28 side. An iron core rotor 17 is fixed onto the outer periphery of large diameter section 13*a* and an eccentric axle section 39 is pressed into and fixed to an inside of large diameter section 13*a* from the axis direction to make the positioning of eccentric axle section 39 in the axial direction by means of the inner surface of step difference section 13*c*.

On the other hand, an annular member 20 is pressed into the outer periphery of small diameter section 13*b* and a commutator 21 is pressed into and fixed to the outer peripheral surface of annular member 20 from the axial direction so that the axial positioning is made by means of the outer surface of step difference section 13*c*. An outer diameter of annular member 20 is set to approximately the same as the outer diameter of large diameter section 13*a*.

The axial length of annular member 20 is set to be slightly shorter than small diameter section 13*b*.

The axial positioning of both of eccentric axle section 39 and commutator 21 by means of inner and outer surfaces of step difference section 13*c* so that an assembly operation becomes facilitated and an accuracy of the positioning can be improved.

Iron core rotor 17 is formed by a magnetic material having a plurality of magnetic poles and an outer peripheral surface of iron core rotor 17 is constituted by a bobbin having slots on which coils of an electromagnetic coil 18 are wound.

On the other hand, commutator 21 is formed in an annular shape by means of an electrically conductive material and a terminal 18*c* of a coil wire drawn out from electromagnetic coil 18 is electrically connected to each of segments divided in the same number as a pole number of iron core rotor 17. In other words, a tip of terminal 18*c* of the coil wire is grasped by a folded section formed at the inner peripheral side of commutator 21 to make the electrical connection.

Permanent magnets 14, 15 are wholly formed in a cylindrical shape and have a plurality of magnetic poles in the circumferential direction thereof. The position in the axial direction of permanent magnets 14, 15 is offset toward the further forward direction than the fixture position of iron core rotor 17.

Specifically, the axial centers of permanent magnets 14, 15 are, as shown in FIG. 1, offset toward the forward direction with respect to the axial center of iron-core rotor 17, in other words, towards stator 16 side by a predetermined distance.

In addition, the offset arrangement of permanent magnets 14, 15 causes forward end sections 14*a*, 15*a* of permanent magnets 14, 15 to be overlapped with first brushes 25*a*, 25*b* of commutator 21 and stator 16 as will be described later.

Figure 5:
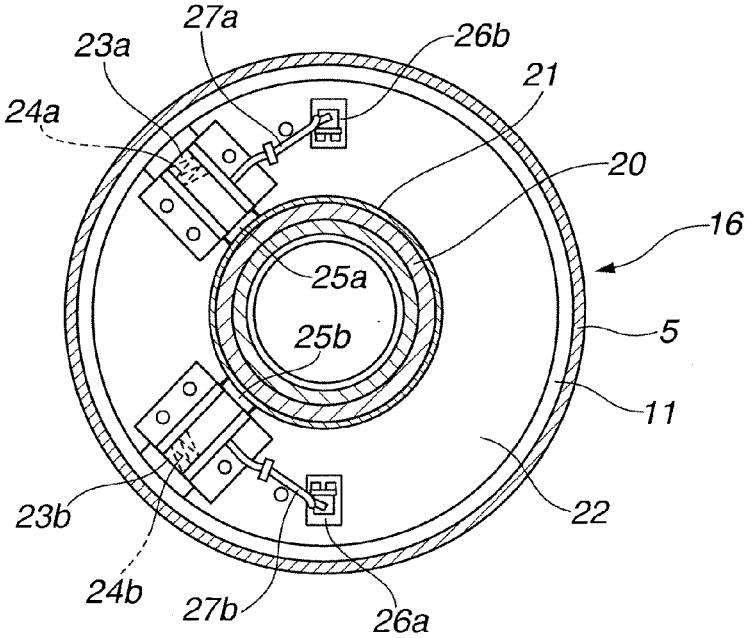
FIG. 5 is a cross sectional view cut away along a line of C to C in FIG. 1.

Stator 16 is, as shown in FIG. 5, mainly constituted by: a disc shaped resin plate 22 integrally mounted at the inner peripheral side of sealing plate 11; a pair of resin holders 23*a*, 23*b* mounted in the inside of resin plate 22; a pair of first brushes 25*a*, 25*b* which are switching brushes (rectifiers) and whose respective tip surfaces are elastically contacted on the outer peripheral surface from the diameter direction by means of a spring force of coil springs 24*a*, 24*b*; inner and outer double annular slip rings 26*a*, 26*b* buried to the forward end surfaces of resin holders 23*a*, 23*b* in a state in which respective end surfaces are exposed; and pigtail harnesses 27*a*, 27*b* which electrically connects respective first brushes 25*a*, 25*b* to respective slip rings 26*a*, 26*b*. It should be noted that slip rings 26*a*, 26*b* constitute part of a power supply mechanism and first brushes 25*a*, 25*b*, commutator 21, pigtail harnesses 27*a*, 27*b* constitute power supply switching means.

Sealing plate 11 is positioned and fixed to a recess step difference section formed on a forward end section of housing 5. In addition, an axial inserting hole 11*a* through which one end section of motor output axle 13 is penetrated is formed at the center section of sealing plate 11.

A brush holding body 28 which is a power supply mechanism is fixed to cover main body 3*a* integrally molded by means of a synthetic resin material 28.

This brush holding body 28 is mainly constituted by, as shown in FIGS. 1 and 2, a substantially cylindrical brush holding body 28*a* formed in a substantially letter L shape as viewed from a side thereof and inserted into a holding hole 3*d*; a connector section 28*b* formed on an upper end section of brush holding section 28*a*; a pair of brackets 28*c*, 28*c* projected integrally on both sides of brush holding section 28*a*; and a pair of terminal pieces 31, 31 a majority of which is buried in an inside of brush holding body 28.

A pair of terminal pieces 31, 31 are formed in parallel to each other along a vertical direction and respective terminals 31*a*, 31*a* on one terminal side (lower end side) of pair of terminal pieces 31, 31 are exposed to bottom end sides of brush holding section 28*a*. Respective terminals 31*b*, 31*b* of the other end side (upper end side) are projected within a female type fitting groove 28*d*. In addition, respective other side terminals 31*a*, 31*b* are electrically connected to a battery power supply via a male terminal (not shown).

Sleeve shaped slide sections 29*a*, 29*b* are fixed within cylindrical penetrating holes formed on a vertical position of an inside of brush holding section 28*a* which is extended in a substantially horizontal direction (axial direction). Respective tip surfaces of second brushes 30*a*, 30*b* contacted on respective slip rings 26*a*, 26*b* from the axial direction are slidably held in the axial direction.

These respective second brushes 30*a*, 30*b* are formed substantially in an elongated body shape. Spring forces of second coil springs 32*a*, 32*b* which are biasing members elastically mounted between one side terminals 31*a*, 31*a* exposed to bottom section sides of respective penetrating holes cause second brushes 30*a*, 30*b* to be biased in respective directions of slip rings 26*a*, 26*b*.

A pair of pig tail harness having a flexibility are welded and fixed between rear end sections of second brushes 30*a*, 30*b* and one side terminals 31*a*, 31*a* to electrically connect both of second brushes 30*a*, 30*b* and one side terminals 31*a*, 31*b*.

In addition, an annular seal member 34 is fitted and held within an annular fitting groove formed on an outer periphery at a base section side of brush holding section 28*a* and seal member 34 is elastically contacted on the tip surface of cylindrical wall 3*b* when brush holding section 28*a* is inserted into holding purpose hole 3*d* to seal within brush holding section 28*a*.

Connector section 28*b* has the upper end section on which other side terminals 31*b*, 31*b* exposed to fitting groove 28*d* into which male terminals (not shown) are inserted electrically connected to a control unit (not shown) via the male type terminals.

Bracket sections 28*c*, 28*c* are formed in a substantially triangular shape and on both side sections thereof bolt inserting holes 28*e*, 28*e* are penetrated and formed. Through respective bolt inserting holes 28*e*, 28*e*, bolts 59, 59 screwed into a pair of female holes (not shown) formed on cover main body 3*a* are fixed to cover main body 3*a* via respective bracket sections 28*c*, 28*c*.

Motor output axle 13 and eccentric axle section 39 are rotatably supported by means of a small diameter ball bearing 37 disposed on an outer peripheral surface of axle section 10*b* at a head section 10*a* side of cam bolt 10 and a needle bearing 38 disposed on an outer peripheral surface of cylindrical section 9*b* of driven member 9 and arranged at the axial direction side section of small diameter ball bearing 37. These small diameter ball bearing 37 and needle bearing 38 constitute a bearing mechanism.

Needle bearing 38 is constituted by a cylindrical retainer 38*a* pressed in the inner peripheral surface of eccentric axle section 39; and a plurality of needle rollers 38*b* which are a plurality of rollable bodies rotatably held on the inner side of retainer 38*a*. This needle roller 38*b* rolls on the outer peripheral surface of cylindrical section 9*b* of driven member 9.

Small diameter ball bearing 37 has the inner wheel grasped and fixed between a forward end edge of driven member 9 and a washer 10*c* of cam bolt 10 and has the outer wheel positioned and supported from the axial direction between a step difference section formed on an inner periphery of motor output axle 13 and a snap ring 45 which is a stopper ring.

A small diameter oil seal 46 is interposed between the outer peripheral surface of motor output axle 13 (eccentric axle section 39) and the inner peripheral surface of extended section 5*d* of housing 5 to block a leakage of lubricant oil from an inside of speed reduction mechanism 8. This oil seal 46 partitions electrically driven motor 12 and speed reduction mechanism 8. When the inner peripheral surface of oil seal 46 is elastically contacted on the outer peripheral surface of motor output axle 13, a frictional resistance is provided for a rotation of output axle 13.

A cap 53 having a cross section in a substantial letter of left inverted U shape is pressed into and fixed to close the spatial section at cam bolt 10 side, as shown in FIG. 1

The above-described control unit detects a present engine driving state on a basis of information signals from various types of sensors such as a crank angle sensor, an airflow meter, a coolant temperature sensor, an accelerator opening angle sensor, and so forth to perform an engine control and supplies electric power to electromagnetic coil 18 to perform a rotational control for motor output axle 13 so as to control a relative rotational phase of camshaft 2 with respect to timing sprocket 1 via a speed reduction mechanism 18 via speed reduction mechanism 8.

As shown in FIGS. 1 through 3, speed reduction mechanism 8 is mainly constituted by: eccentric axle section 39 performing an eccentric rotary motion; a middle diameter ball bearing 47 disposed on the outer periphery of eccentric axle section 39; roller 48 disposed on the outer periphery of middle diameter ball bearing 47; holder 41 allowing the movement of roller 48 in the radial direction while holding roller 48 in a roll direction; and driven member 9 integral with holder 41.

Eccentric axle section 39 is formed cylindrically in a step difference diameter and small diameter section 39*a* at the forward end side of eccentric axle section 39 is pressed into and fixed to the inner peripheral surface of large diameter section 13*a* of motor output axle 13. An axle center Y of a cam surface formed on the outer peripheral surface of large diameter section 39*b* at the rear end side is slightly eccentric in the diameter direction from axle center X of motor output axle 13. It should be noted that middle diameter ball bearing 47 and roller 48 constitute a planetary gear section.

Middle diameter ball bearing 47 is arranged in a state in which the whole of needle bearing 38 is approximately overlapped in a radial direction position of needle bearing 38 and includes an inner wheel 47*a*, an outer wheel 47*b*, and a ball 47*c* interposed between inner and outer wheels 47*a*, 47*b*. Inner wheel 47*a* is press fitted to the outer peripheral surface of eccentric axle section 39 but outer wheel 47*b* is in a free state without fixture in the axle direction. In other words, this outer wheel 47*b* is in a free state since one end surface of electrically driven motor 12 side does not contact on any position and a minute first gap C' is formed between the other end surface 47*d* of ball bearing 47 in the axial direction of outer wheel 47*b* and an inner side surface of holder 41 opposing against the other end surface 47*d*. An outer peripheral surface of each roller 48 is rollably contacted against an outer peripheral surface of outer wheel 47*b* as shown in FIG. 2. An annular second gap C1 is formed on the outer peripheral side of outer wheel 47*b*. This second gap C1 causes a whole of middle diameter ball bearing 47 to be movable in the diameter direction involved in an eccentric rotation of eccentric axle section 39, in other words, eccentrically movable.

Each roller 48 is formed of the iron-series metal and fitted into inner teeth 19*a* of inner teeth constituent section 19 while each roller 48 is moved in the radial direction due to the eccentric motion of middle diameter ball bearing 47 and each roller 48 is swingably moved in the radial direction while guided in the peripheral direction of holder 41 by means of both side edges of roller holding hole 41*b* of holder 41.

Lubricating oil is supplied to an inside of speed reduction mechanism 8 by means of lubricating oil supply means. This lubricating oil supply means includes: an oil supply passage formed in the inside of the bearing of the cylinder head and to which the lubricating oil is supplied from a main oil gallery not shown; an oil supply hole 51 formed in a direction of the inner axle of camshaft 2 and communicated with the oil supply passage via a groove; a small diameter oil hole 52 having one end opened to oil supply hole 51 and the other end opened to the vicinity to middle diameter ball bearing 47 and needle bearing 38; and large diameter three oil exhaust holes (not shown) penetrated through driven member 9.

Thus, lubricating oil is supplied to the insides of eccentric axle section 39 and motor output axle 13 by above-described lubricating oil supply means and serve to lubricate needle bearing 38 and ball bearing 37 and lubricating oil is also supplied to spatial section 44 and retained therein from which lubricating oil is sufficiently supplied to movable sections of middle diameter ball bearing 47 and each roller 48. It should be noted that the leakage of lubricating oil retained within spatial section 44 within housing 5 is blocked by means of small diameter oil seal 46.

Hereinafter, an action of the preferred embodiment described above will be explained below. First, when the crankshaft of the engine is rotationally driven, timing sprocket 1 is revolved via the timing chain, its rotational force synchronously revolves electrically driven motor 12, namely, housing 5 via inner teeth constituent section 19 and female screw forming section 6. On the other hand, the rotational force of inner teeth constituent section 19 is transmitted from each roller 48 to camshaft 2 via holder 41 and driven member 9. Thus, the cam of camshaft 2 is operated to open or close the corresponding intake valve.

Then, at a time of a predetermined engine driving after the start of engine, the electrical power supply to electromagnetic coil 17 of electrically driven motor 12 is carried out from the control unit via respective terminal pieces 31, 31, respective pigtail harnesses 32*a*, 32*b*, second brushes 30*a*, 30*b*, respective slip rings 26*a*, 26*b*, and so forth. Thus, output axle 13 of motor 12 is rotationally driven and its rotational force is speed reduced via speed reduction mechanism 8 and rotational force speed reduced is transmitted to camshaft.

That is to say, when eccentric axle section 39 is eccentrically rotated due to the rotation of output axle 13 of electrically driven motor 12, each roller 48 rolls and moves riding across one of inner teeth 19*a* and rolls an adjacent another one of teeth 19*a* while each roller 48 is guided in the radial direction through each roller holding hole 41*b* of holder 41 for each rotation of motor output axle 13. This is sequentially repeated so as to be rollably contacted in the circumferential direction. The rollable contact of each roller 48 reduces the rotation of motor output axle 13 and the rotating force is transmitted to driven member 9. The speed reduction ratio at this time can arbitrarily be set according to the number of rollers 48.

This causes the relative rotation in the normal or revere direction of camshaft 2 with respect to timing sprocket 1 to convert the relative rotation phase so that the open-or-closure timing of the intake valve(s) is converted and controlled toward the advance angle side or in the retardation angle side.

The maximum position limitation (angular position limitation) in the normal and reverse rotation of camshaft 2 with respect to timing sprocket 1 is carried out in such a way that each side surface of stopper convex section 61*b* is contacted on either one of respective opposing surfaces of stopper recess grooves 2*b*.

Specifically, driven member 9 is revolved in the same direction as the rotation direction of timing sprocket 1 due to (or involved in) the eccentric pivotal movement of eccentric axle section 39 so that one side surface of stopper convex section 61*b* is contacted on opposing surface 1*c* of stopper recess groove 2*b* and the rotation of the same direction is limited. Thus, the relative rotational phase of camshaft 2 to timing sprocket 1 is modified maximally toward the advance angle side.

On the other hand, driven member 9 is rotated in the opposite direction to the rotation direction of timing sprocket 1 so that the other side surface of stopper convex section 61*b* is contacted on the opposing surface 2*d* of the other side of stopper recess groove 2*b* for the further rotation in the same direction is limited. Thus, relative rotational phase of camshaft 2 with respect to timing sprocket 1 is maximally modified toward the retardation angle side.

Consequently, the valve open-and-closure timings of the intake valves are maximally converted at the advance angle side or the retardation angle side so that the fuel economy of the engine and the improvement in the output can be achieved.

In addition, in this embodiment, when the respective components are assembled, in other words, when cover member 3 with respect to phase modification mechanism 4 is assembled, other end sections 54*b*, 55*b* of respective positioning pins 54, 55 are previously pressed into and fixed to other end sections 54*b*, 55*b* of press in holes 57*b*, 58*b* of tip sections 57*a*, 58*a* of projection sections 57, 58 disposed on bearing member 42 of camshaft 2.

Subsequently, when bearing member 42 is assembled into the cylinder head, one end sections 54*a*, 55*a* of respective positioning pins 54, 55 are loosely (movably) inserted into respective inserting holes 49*c*, 49*d* of chain cover 49.

Thereafter, cover member 3 to which large diameter oil seal 50 is prefixed via circular base section 50*a* is tightened to chain cover 49 by means of bolts. However, at this time, each positioning pin hole 3*i*, 3*j* is made coincident with corresponding one end section 54*a*, 55*a* of each of positioning pins 54, 55 and the corresponding positioning pin is inserted into corresponding pin hole 3*i*, 3*j*. Thus, the radial positioning and circumferential positioning of cover member 3 with respect to chain cover 49 are carried out so that while, in this state, assembling flange 3*b* is contacted on the forward surface of circular wall 49*b* of chain cover 49, cover member 3 is fixed by means of the bolts.

In this way, in this embodiment, while cover member 3 is positioned, cover member 3 is fixed to chain cover 49, with bearing member 42 of camshaft 2 as a reference utilizing each projection section 57, 58. Hence, while the positional deviation between cover member 3 and phase modification mechanism 4 is suppressed, the assembly work of the respective components can be facilitated.

That is to say, camshaft 2 is fixed from the axial direction by means of cam bolt 10 while phase modification mechanism 4 is highly accurately positioned. In addition, cover member 3 is positioned by means of two positioning pins 54, 55 fixed to respective projection sections 57, 58 integral to bearing member 42 of camshaft 2. It is possible to make highly accurate positioning of cover member 3 and phase modification mechanism 4 in the radial and circumferential directions.

Hence, the radial directional positional accuracy and the circumferential positional accuracy of respective brushes 30*a*, 30*b* disposed on cover member 3 side and respective slip rings 26*a*, 26*b* disposed at phase modification mechanism 4 side are improved and the positional deviation between these members can be suppressed.

In addition, the radial directional positioning accuracy of large diameter oil seal 50 with respect to the outer peripheral surface of housing 5 is improved so that a gradient of oil seal 50 and a radial directional positional deviation can be suppressed.

Furthermore, while the positioning of cover member 3 is carried out utilizing respective projection sections 57, 58, cover member 3 is fixed to chain cover 49 by means of bolts. Hence, these assembly work can be facilitated.

Furthermore, seal ring 56 attached onto cover member 3 has six stopper projection sections 56*b* strongly elastically contacted on the opposing surface of seal holding groove 3*k* of seal ring 56 from the radial direction of seal holding groove 3*k*. Hence, the holding force of seal ring 56 to seal holding groove 3*k* is improved. Consequently, an unintentional drop out of seal ring 56 from seal holding groove 3*k* during the assemble work can be eliminated.

In addition, since one positional pin hole 3*j* is formed in the elongated hole along the radial direction, a slight positional deviation in the radial direction of cover member 3 with respect to respective positional pins 54, 55 can be absorbed.

In this embodiment, as described above, one coil winding 18*a* of electromagnetic coil 18 is adjacently disposed at commutator 21 (axial direction) side and other coil winding 18*b* can be housed in recess section 5*e* of housing bottom section 5*b* from the axial direction. Thus, it becomes possible to reduce an axial length of the apparatus as small as possible. Consequently, a mountability of the apparatus on the internal combustion engine can be improved.

The present invention is not limited to the structure described in the embodiment but can arbitrarily be modified within a range of a gist of the present invention.

In addition, as the eccentric axle section, a wall thickness of inner wheel 47 of middle diameter ball bearing 47 may circumferentially be varied so as to be eccentric to the axial center of ball bearing 47. In this case, since motor output axle 13 may be extended or may be formed as a co-axial cylindrical section, with abolishment of eccentric axle section 39.

Technical ideas of the invention other than the claims graspable from the embodiment will hereinafter be described below.

[Claim a] The valve timing control apparatus for the internal combustion engine as claimed in claim 1, wherein a seal ring which is constituted by an elastic body arranged along a peripheral direction of the cover member is interposed between the cover member and a fixture surface of the internal combustion engine to which the cover member is fixed and the positioning pins are disposed at an inner peripheral side of the seal ring.

[Claim b] The valve timing control apparatus for the internal combustion engine as set forth in claim a, wherein the seal ring is arranged within a seal groove formed on a contact surface provided on an outer peripheral section of the cover member and a stopper section having a larger width than a groove width of the seal groove is partially mounted on the seal ring.

[Claim c] The valve timing control apparatus for the internal combustion engine as set forth in claim b, wherein the stopper section is constituted by a pair of projections projected toward the inner peripheral side of the seal ring and toward the outer peripheral side of the seal ring.

[Claim d] The valve timing control apparatus for the internal combustion engine as set forth in claim c, wherein the pair of projections are disposed at a plurality of locations of the seal ring in a circumferential direction of the seal ring.

[Claim e] The valve timing control apparatus for the internal combustion engine as claimed in claim 1, wherein the positioning pins are two.

[Claim f] The valve timing control apparatus for the internal combustion engine as set forth in claim e, wherein the pair of positioning pins are disposed at opposing positions with an axial center of the camshaft as a center.

[Claim g] The valve timing control apparatus for the internal combustion engine as claimed in claim e, wherein each of the positioning pins has one end press fitted into a projection section of the bearing member and one side of the cover member and has the other end inserted into the other side of the cover member.

[Claim h] The valve timing control apparatus for the internal combustion engine as set forth in claim 1, wherein each of the positioning pins has one end press fitted into a pressing in pin hole formed on the projection section and has the other end inserted into an inserting hole formed on the cover member.

This application is based on a prior Japanese Patent Application No. 2012-245000 filed in Japan on Nov. 7, 2012. The entire contents of this Japanese Patent Application No. 2012-245000 are hereby incorporated by reference. Although the invention has been described above by reference to certain embodiments of the invention, the invention is not limited to the embodiment described above. Modifications and variations of the embodiments described above will occur to those skilled in the art in light of the above teachings. The scope of the invention is defined with reference to the following claims.

What is claimed is:

1. A valve timing control apparatus for an internal combustion engine, comprising:

a driving rotary body to which a rotational force is transmitted from a crankshaft;

a driven rotary body fixed to a camshaft;

an electrically driven motor fixed to the driving rotary body;

a speed reduction mechanism configured to reduce a rotation of the electrically driven motor and to transmit the reduced rotation to the driven rotary body;

a phase modification mechanism which is capable of modifying a relative rotational phase of the camshaft with respect to the driving rotary body in accordance with an engine state;

a cover member arranged at the tip side of the phase modification mechanism and fixed to a chain cover of the internal combustion engine;

a pair of inner and outer periphery slip rings disposed on either one of a tip surface of the phase modification mechanism or another tip surface of the cover member opposed to the tip surface of the phase modification mechanism to supply an electric power to the electrically driven motor; and a pair of brushes disposed on either the other of the tip surface of the phase modification mechanism or the other tip surface of the cover member and constructed to slidably contact on the respective slip rings, wherein a plurality of projection sections projected toward the cover member are integrally mounted on a bearing member configured to rotatably journalize the camshaft and a plurality of positioning pins are extended over the cover member and the respective projection sections.

2. The valve timing control apparatus for the internal combustion engine as claimed in claim 1, wherein a seal ring which is constituted by an elastic body arranged along a peripheral direction of the cover member is interposed between the cover member and a fixture surface of the internal combustion engine to which the cover member is fixed and the positioning pins are disposed at an inner peripheral side of the seal ring.

3. The valve timing control apparatus for the internal combustion engine as claimed in claim 2, wherein the seal ring is arranged within a seal groove formed on a contact surface provided on an outer peripheral section of the cover member and a stopper section having a larger width than a groove width of the seal groove is partially mounted on the seal ring.

4. The valve timing control apparatus for the internal combustion engine as claimed in claim 3, wherein the stopper section is constituted by a pair of projections projected toward the inner peripheral side of the seal ring and toward the outer peripheral side of the seal ring.

5. The valve timing control apparatus for the internal combustion engine as claimed in claim 4, wherein the pair of projections are disposed at a plurality of locations of the seal ring in a circumferential direction of the seal ring.

6. The valve timing control apparatus for the internal combustion engine as claimed in claim 1, wherein the positioning pins are two.

7. The valve timing control apparatus for the internal combustion engine as claimed in claim 6, wherein one of the positioning pins has one end press fitted into a projection section of the bearing member and one side of the cover member and has the other end inserted into the other side of the cover member.

8. The valve timing control apparatus for the internal combustion engine as claimed in claim 1, wherein the pair of positioning pins are disposed at opposing positions with an axial center of the camshaft as a center.

9. The valve timing control apparatus for the internal combustion engine as claimed in claim 1, wherein each of the positioning pins has one end pressed into a pressing in pin hole formed on the projection section and has the other end inserted into an inserting hole formed on the cover member.

10. The valve timing control apparatus for the internal combustion engine as claimed in claim 9, wherein the inserting hole is formed in an elongated hole along the radial direction of the cover member.

11. The valve timing control apparatus for the internal combustion engine as claimed in claim 1, wherein the cover member and each of the projection sections are arranged in order for the chain cover to be interposed between the cover member and each of the projection sections.

12. The valve timing control apparatus for the internal combustion engine as claimed in claim 11, wherein each of the positioning pins is movably inserted into an inserting hole disposed in the chain cover.

13. A valve timing control apparatus for an internal combustion engine, comprising:

a driving rotary body to which a rotational force is transmitted from a crankshaft;

a driven rotary body fixed to a camshaft;

an electrically driven motor fixed to the driving rotary body;

a speed reduction mechanism configured to reduce a rotation speed of the electrically driven motor and to transmit the speed reduced rotation to the driven rotary body;

a phase modification mechanism which is capable of modifying a relative rotational phase of the camshaft with respect to the driving rotary body in accordance with an engine state;

a cover member arranged at a tip side of the phase modification mechanism and fixed to a side surface of the internal combustion engine;

a pair of inner and outer periphery slip rings disposed on either one of a tip surface of the phase modification mechanism or another tip surface of the cover member opposed to the tip surface of the phase modification mechanism to supply an electric power to the electrically driven motor; and a pair of brushes disposed on either the other of the tip surface of the phase modification mechanism or the other tip surface of the cover member and constructed to slidably contact on the respective slip rings, wherein the cover member is fixed to the side surface of the internal combustion engine in a state in which the cover member is positioned from a radial direction of the camshaft with respect to a rotation center of the camshaft by means of a positioning section disposed on a bearing member rotatably journaling the camshaft.

14. A valve timing control apparatus for an internal combustion engine, comprising:

a driving rotary body to which a rotational force is transmitted from a crankshaft;

a driven rotary body fixed to a camshaft;

an electrically driven motor fixed to the driving rotary body;

a speed reduction mechanism configured to reduce a rotation of the electrically driven motor and to transmit the reduced rotation to the driven rotary body;

a phase modification mechanism which is capable of modifying a relative rotational phase of the camshaft with respect to the driving rotary body in accordance with an engine state;

a cover member arranged at a tip side of the phase modification mechanism to cover at least part of the phase modification mechanism and fixed to a chain cover of the internal combustion engine; and a seal member fixed to either one of an inner periphery of the cover member and an outer periphery of the phase modification mechanism to slide on either the other of the inner periphery of the cover member and the outer periphery of the phase modification mechanism, wherein a plurality of projection sections projected toward the cover member are integrally mounted on a bearing member rotatably journaling the camshaft and positioning pins are interposed between the cover member and the respective projection sections.

15. The valve timing control apparatus for the internal combustion engine as claimed in claim 14, wherein the cover member is fixed to the chain cover in a state in which the cover member is positioned in a radial direction of the camshaft with respect to a rotation center of the camshaft by means of the positioning pins.

* * * * *